US007283756B2

(12) United States Patent
Suzuki

(10) Patent No.: US 7,283,756 B2
(45) Date of Patent: Oct. 16, 2007

(54) IMAGE FORMING APPARATUS

(75) Inventor: Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 11/156,798

(22) Filed: Jun. 21, 2005

(65) Prior Publication Data

US 2006/0002723 A1 Jan. 5, 2006

(30) Foreign Application Priority Data

Jul. 2, 2004 (JP) ..... 2004-197395

(51) Int. Cl.
*G03G 15/08* (2006.01)

(52) U.S. Cl. ..... 399/27; 399/49

(58) Field of Classification Search ..... 399/9, 399/24, 27, 28, 29, 49, 60, 298, 301
See application file for complete search history.

(56) References Cited

U.S. PATENT DOCUMENTS 6,501,916 B2 * 12/2002 Suzuki ..... 399/30
6,775,489 B2 * 8/2004 Tsuruya et al. ..... 399/49
6,975,338 B2 * 12/2005 Hirai et al. ..... 347/133
7,043,171 B2 * 5/2006 Ogata ..... 399/61

FOREIGN PATENT DOCUMENTS

JP 8-220870 8/1996

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image density control feature based on a result detected by an image density detection portion, where a developer amount per 10 mm in a longitudinal direction of a first chamber of a developer carrying member is Y (g), a developer carrying velocity in the longitudinal direction inside the first chamber is $V_D$ (mm/sec), a toner carrying amount per unit area on an image bearing member when forming a maximum density is M (mg/cm$^2$), a surface movement velocity of the image bearing member is $V_p$ (mm/sec), and a distance from a position furthest downstream in a developer conveyance direction in a maximum area in which development is possible on the developer carrying member to a predetermined detection position in the maximum area in the longitudinal direction is X (mm), and the following relation is satisfied:

$$X \leqq (45 \times Y \times V_D)/(M \times V_p).$$

4 Claims, 10 Drawing Sheets

IMAGE FORMING APPARATUS

BACKGROUND OF THE INVENTION

1. Field of the Invention

The present invention relates to an image forming apparatus which utilizes an electrophotographic method, electrostatic recording method or the like to form a recorded image by developing an electrostatic image formed on an image bearing member using developer, and particularly can be advantageously applied to an image forming apparatus that uses two-component developer comprising a toner and a carrier as a developer.

2. Related Background Art

An image forming apparatus that employs an electrophotographic method is known in which, for example, a latent image that was formed on an image bearing member thereof is developed using developer and visualized as a toner image. In a developing device that uses two-component developer comprising a toner and a carrier, it is important that the mixing ratio for the toner (T) and the carrier (C) of the developer, that is, T/D (D=T+C) (indicates the "toner density" in the developer; hereunder also referred to as "T/D ratio") is kept constant. Therefore, several methods including a light reflection detection method, an inductance method and a patch detection method have already been proposed for an auto toner replenisher (ATR) as means of detecting the toner density of a developer in the developing device and controlling the toner density.

However, the following problem exists with regard to the light reflection detection method. That is, when the toner of the developer uses as a colorant a coloring agent, such as carbon, that exhibits the same optical properties as the carrier, it is not possible to detect the T/D ratio on the basis of the difference in the light reflection intensity of the developer.

Further, the following problem exists with regard to the inductance method that performs detection based on changes in the magnetic permeability of the developer. That is, the charging charge amount of the toner may be increased and the fluidity improved for the purpose of enhancing image quality. In this case, even if the developer is agitated and the like, a change in the density of the carrier may occur due to repulsion of the charged developer. As a result, since the magnetic permeability of the developer changes even though the T/D ratio is the same, there are cases in which an accurate T/D ratio is not detected.

Thus, the following method is known as a method that measures the T/D ratio of developer in an auto toner replenisher (ATR). That is, a latent image of a constant potential (reference patch latent image) is formed on an image bearing member separately to the normal image formation, and a patch image (image for image density control) is then formed as a reference density pattern by directly developing this latent image. Subsequently, the density of this patch image on an image bearing member or on a transferring member after the patch image was transferred to the transferring member from an image bearing member is optically detected using an image density sensor as image density detection means. The T/D ratio is then determined utilizing the fact that the density of the patch image correlates with the T/D ratio. This method is called "patch detection method" (patch detection ATR).

In many conventional image forming apparatuses an image density sensor for detecting the density of a patch image is provided facing an image bearing member or a member for transfer (recording material carrying member, intermediate transferring member or the like) to which a patch image is transferred from an image bearing member, in a position in the vicinity of the center in the thrust direction (direction roughly perpendicular to the direction of movement of the surface of the image bearing member or the member for transfer).

A conventional developing device will now be described referring to FIG. 2. In the figure, a developing device 1 comprises developer conveying means 106 and 107 inside a developing container 101. Developer that was supplied by the developer conveying means 106 and 107 to the surface of a developing sleeve 102 as a developer carrying member is carried by rotation of the developing sleeve 102 to a cylindrical electrophotographic photosensitive member (photosensitive member) as an image bearing member, that is, to a portion (developing area) facing a photosensitive drum 3.

Further, in the example in FIG. 2, the inside of the developing container 101 is divided into a developing chamber (first chamber) 110 and an agitating chamber (second chamber) 111 by a partition wall 109 that extends in a vertical direction. A two-component developer comprising non-magnetic toner and a magnetic carrier is contained inside the developing chamber 110 and agitating chamber 111.

In the developing chamber 110 and the agitating chamber 111 are respectively disposed a first developer conveying means (first screw) 106 and a second developer conveying means (second screw) 107 that are generally of a screw type. The first screw 106 agitates and carries the developer in the developing chamber 110. When toner is supplied from a toner replenishing container (not shown in the figure) through a toner replenishing port (not shown in the figure), the second screw 107, under the control of an auto toner replenisher (ATR), carries the supplied toner and agitates it with the developer that is already in the agitating chamber 111 to make the toner density uniform. The toner replenishing port is normally provided near the upstream side in the direction in which developer is carried by the second screw 107 inside the agitating chamber 111.

The first screw 106 and the second screw 107 carry the developer in respectively opposite directions. That is, the first screw 106 carries developer from the rear side of the page space towards the front side in FIG. 2, and the second screw 107 carries developer from the front side of the page space towards the rear side in FIG. 2. Further, in the partition wall 109, at the edge between the front side and the rear side in FIG. 2, developer passages (not shown in the figure) are formed that interconnect the developing chamber 110 and the agitating chamber 111. Accordingly, through the carrying forces of the first screw 106 and the second screw 107, developer in the developing chamber 110 in which toner density decreased due to consumption of toner in the developing process moves into the agitating chamber 111 through one of the developer passages. Further, developer inside the agitating chamber 111 into which toner was replenished and agitated moves into the developing chamber 110 through the other developer passage.

During this developer circulation, conventionally a patch image is generally formed near the center in the thrust direction of the developing sleeve 102 (direction roughly perpendicular to the direction of movement of the surface), and the patch image is detected with an image density sensor 41 that is provided in a corresponding position.

However, the following problem was found to exist when toner replenishment is performed, as described above, by an auto toner replenisher (ATR) in accordance with a detection result obtained by detecting the density of a patch image formed in a center portion in the thrust direction of the developing sleeve 102. That is, when a patch image is formed at a center portion in the thrust direction of the developing sleeve 102 as described above, during the period that developer that was in a position inside the developing container 101 corresponding to the formation position of the patch image on the developing sleeve 102 when the patch image was formed circulates as far as the position of the toner replenishing port 108, toner in the developer is consumed by an image formed immediately after formation of the patch image. Therefore, in the case of replenishing toner based on a result obtained by detecting the density of the patch image, the T/D ratio when actually replenishing the toner may be different from that at the time of patch image formation, and therefore it is not possible to control the T/D ratio appropriately.

For example, in a case in which a high density image was formed immediately after patch image formation, the T/D ratio at the toner replenishing port will be in a lower state than the state of the developer at the time the patch image was formed. As a result, since the toner replenishment amount is insufficient, an appropriate T/D ratio will not be obtained.

The present invention was made in light of the above-described problems.

In this connection, Japanese Patent Application Laid-Open No. H8-220870 considered the problem that, in the case of copy modes in which there are large variations in the toner consumption amount, for example, when switching from continuous copying of black solid copies to continuous copying of blank copies, although toner replenishment is at a maximum during the continuous copying of black solid copies, when the copying of blank copies subsequently starts the balance between the toner replenishment amount and the toner density collapses, and it proposed providing image density detection means (means employing a light reflection detection method that detects the density of a patch image formed on a photosensitive drum) or developer density detection means (means employing a light reflection detection method that directly detects the toner density of the developer) at the rear side and front side in the longitudinal direction of the developing device, respectively. The invention according to Japanese Patent Application Laid-Open No. H8-220870 is directed at conducting toner replenishment control in accordance with the difference in the detection results of the two detection means to prevent the problem described in the foregoing discussion and also enable the size of the developing device to be reduced. However, the invention of Japanese Patent Application Laid-Open No. H8-220870 does not consider at all the problem of errors in toner replenishment control due to consumption of toner in an area past a patch image formation position in the developer carrying direction. Further, it contains no disclosure or suggestion with respect to converting a toner amount that is actually used in an area past a patch image formation position into a value indicating a fluctuation in the T/D ratio inside the developing device.

SUMMARY OF THE INVENTION

An object of this invention is to provide an image forming apparatus that can stabilize the toner density of a developer to an appropriate state, and maintain the stabilized image density.

A preferable image forming apparatus for achieving the above-described object comprises the following:

an image bearing member on which an electrostatic image is formed;

developing means comprising a developing container which contains developer comprising a carrier and a toner, a developer carrying member which is provided at an opening portion of the developing container and which carries the developer, and a developer conveying member which is disposed inside the developing container and which carries developer in the vicinity of the developer carrying member in the longitudinal direction of the developer carrying member, the developing means developing the electrostatic image on the image bearing member;

wherein the developing container comprises a first chamber having the opening portion and in which the developer conveying member is disposed, and a second chamber for returning developer that was carried from the first chamber;

control image formation means that forms an image for image density control comprising the toner on the image bearing member;

image density detection means that detects in a predetermined detection position the density of the image for image density control on the image bearing member or on a transferring medium to which an image on the image bearing member is transferred; and image density control means that performs image density control based on a detection result from the image density detection means;

wherein, when a developer amount per 10 mm in the longitudinal direction of the developer carrying member inside the first chamber is taken as Y (g), a developer carrying velocity in the longitudinal direction of the developer carrying member inside the first chamber is taken as VD (mm/sec), a toner carrying amount per unit area on the image bearing member at the time of formation of a maximum density image is taken as M (mg/cm$^2$), a surface movement velocity of the image bearing member is taken as $V_p$ (mm/sec), and the distance from a position furthest downstream in the direction in which developer is conveyed by the developer conveying member in the maximum area in which development is possible on the developer carrying member to the predetermined detection position in the longitudinal direction of the developer carrying member is taken as X (mm), the following relation is satisfied:

$$X \leqq (45 \times Y \times V_D)/(M \times V_p).$$

DETAILED DESCRIPTION OF THE EMBODIMENTS

Hereunder, the image forming apparatus of this invention is described in further detail in accordance with the drawings.

Embodiment 1

(Overall Configuration and Operation of Image Forming Apparatus)

Figure 1:
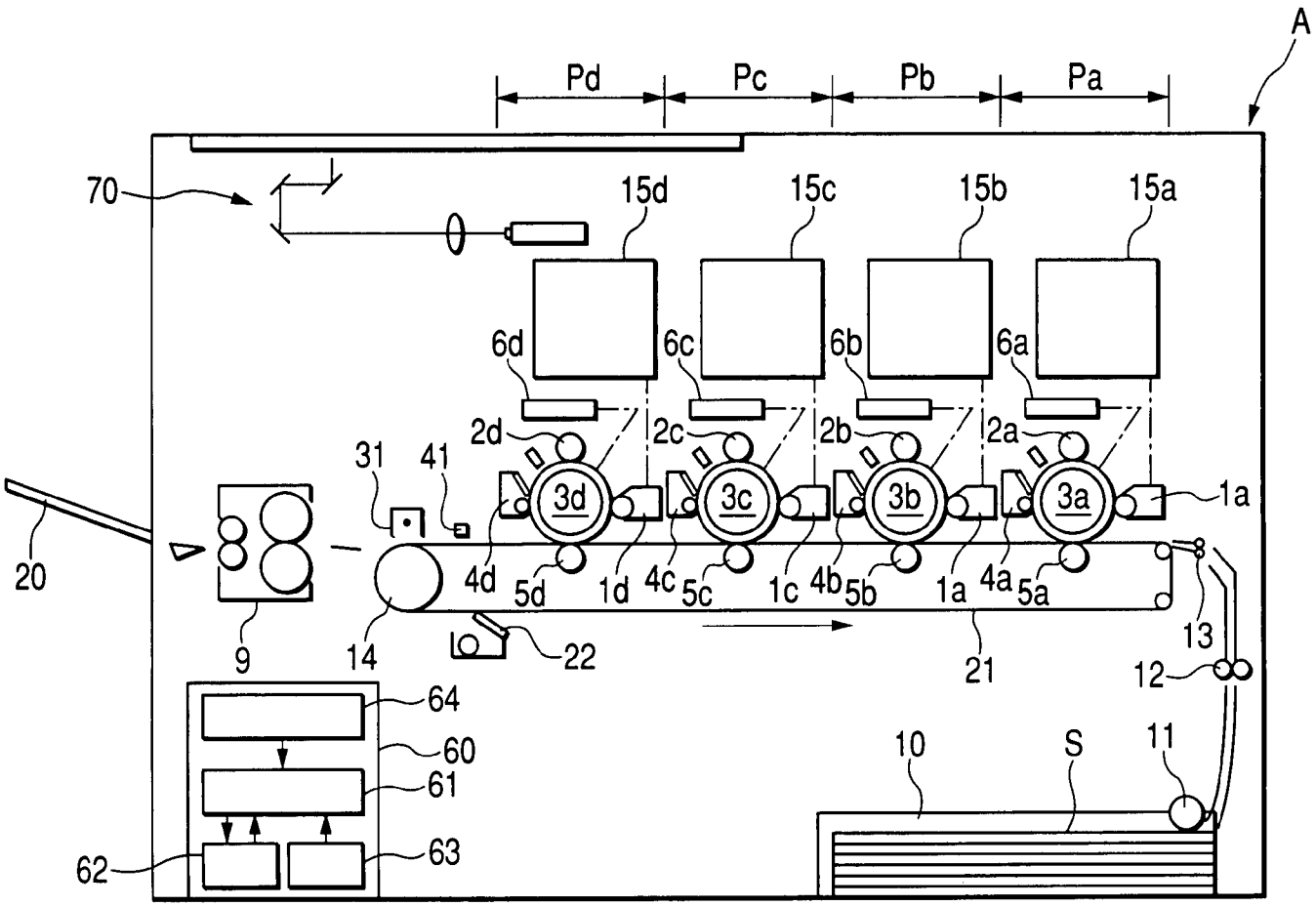
FIG. 1 is a view showing an outline of the overall configuration of one embodiment of the image forming apparatus of this invention.

First, the overall configuration and operation of the image forming apparatus of this embodiment will be described. FIG. 1 shows an outline of the overall configuration of the image forming apparatus of this embodiment. In this embodiment this invention is embodied by an electrophotographic color copying machine (hereunder, referred to simply as "image forming apparatus"). An image forming apparatus A of this embodiment can form a four color full color image comprising yellow (Y), magenta (M), cyan (C) and black (Bk) on a recording material such as, for example, a recording paper, a plastic sheet (OHP sheet) or fabric in accordance with image information from an original reading portion 70 that is comprised by the main body of the image forming apparatus (main body of the apparatus) or from an external device such as a personal computer that was connected in a detachably attachable condition to the main body of the apparatus.

The image forming apparatus A of this embodiment is a color image forming apparatus that employs a tandem-type direct transfer method. Inside the main body of the apparatus, a transferring belt 21 is provided as a recording material carrying member that is suspended around a plurality of supporting rollers. The transferring belt 21 rotates in the direction indicated by the arrow in the figure, and conveys a recording material S that is carried thereon. A first, second, third and fourth image forming portion Pa, Pb, Pc and Pd are provided side by side along the transferring belt 21 as image forming means. For example, when forming a four color full color image, toner images of yellow, magenta, cyan and black are sequentially formed by these first to fourth image forming portions Pa, Pb, Pc and Pd through a process of latent image formation, development, and transfer.

The first to fourth image forming portions Pa, Pb, Pc and Pd are equipped with dedicated image bearing members (photosensitive drums) 3*a*, 3*b*, 3*c* and 3*d*, respectively, and a toner image of each color is formed on the respective photosensitive drums 3*a*, 3*b*, 3*c* and 3*d*. The transferring belt 21 is provided in a position adjacent to each of the photosensitive drums 3*a*, 3*b*, 3*c* and 3*d*, and toner images of each color that were formed on the photosensitive drums 3*a*, 3*b*, 3*c* and 3*d*, respectively, are transferred onto the recording material S that is carried and conveyed on the transferring belt 21. The recording material S onto which toner images of each color were transferred is then separated from the transferring belt 21 by a separation charging device 31, heated and pressed by a fixing portion 9 to fix the toner, and then discharged to outside the apparatus as a recorded image. A belt made in an endless shape or a belt without seams (seamless belt) can be used as the transferring belt 21. The transferring belt 21 is driven by a driving roller 14 to move in a circulating manner (rotate).

More specifically, around the circumference of the photosensitive drums 3*a*, 3*b*, 3*c* and 3*d* are respectively provided charging devices 2*a*, 2*b*, 2*c* and 2*d* as charging means, exposing apparatuses (in this embodiment, a laser exposure optical system) 6*a*, 6*b*, 6*c* and 6*d* as exposing means, developing devices 1*a*, 1*b*, 1*c* and 1*d* as developing means, transfer charging devices 5*a*, 5*b*, 5*c* and 5*d* as transferring means, and photosensitive drum cleaners 4*a*, 4*b*, 4*c* and 4*d* as image bearing member cleaning means. Further, the exposing apparatuses 6*a*, 6*b*, 6*c* and 6*d* each have a light source apparatus and a polygon mirror. Thus, by scanning laser light emitted from the light source apparatus by rotating the polygon mirror, the luminous flux of the scanning light is deflected by a reflection mirror and focused on the generating lines of the photosensitive drums 3*a*, 3*b*, 3*c* and 3*d* by an f-θ lens for exposure. As a result, latent images are formed in accordance with image signals on the photosensitive drums 3*a*, 3*b*, 3*c* and 3*d*.

The developing devices 1*a*, 1*b*, 1*c* and 1*d* are filled with a predetermined amount of two-component developer comprising a magnetic carrier (carrier) and non-magnetic toner (toner) of yellow, magenta, cyan and black, respectively. The toner and the carrier are mixed at a predetermined mixing ratio (T/D ratio). The developing devices 1*a*, 1*b*, 1*c* and 1*d* develop latent images on the respective photosensitive drums 3*a*, 3*b*, 3*c* and 3*d* to visualize the latent images as a yellow toner image, a magenta toner image, a cyan toner image and a black toner image.

The recording material S is contained in a recording material cassette 10 and is supplied from there onto the transferring belt 21 via a pick-up roller 11, a plurality of conveying rollers 12 and a registration roller 13. The recording material S is then conveyed by the transferring belt 21 and fed in order to transferring portions facing the photosensitive drums 3*a*, 3*b*, 3*c* and 3*d*.

More specifically, the recording material S that was fed onto the transferring belt 21 from the registration roller 13 is conveyed towards the transferring portion of the first image forming portion Pa. Simultaneously thereto, an image writing signal enters an ON state, and at a predetermined timing that takes that as a reference, image formation is conducted for the photosensitive drum 3*a* of the first image forming portion Pa. Then, at a transferring portion where the transfer charging device 5*a* and the photosensitive drum 3*a* face each other through the transferring belt 21, the transfer charging device 5*a* imparts an electric field or charge to transfer a toner image of the first color that was formed on the photosensitive drum 3*a* onto the recording material S. The recording material S is held firmly on the transferring belt 21 by the electrostatic attraction force generated by the transfer of this first color toner image, and conveyed to the second image forming portion Pb and onward.

The formation of toner images on the photosensitive drums 3*b*, 3*c* and 3*d* at the second to fourth image forming portions Pb to Pd and the subsequent transfer of the toner images is carried out in the same manner as for the first image forming portion Pa. Thus, a multi-toner image in which toners of four different colors were superposed is formed on the recording material S that is conveyed on the transferring belt 21. Next, the charge of the recording material S onto which the four color toner image was transferred is eliminated by the separation charging device 31 at a downstream portion in the conveying direction of the transferring belt 21, and by attenuation of the electrostatic attraction force the recording material S separates from the end of the transferring belt 21.

The recording material S that separated from the transferring belt 21 is conveyed to the fixing apparatus 9, where blending of the toner images and fixing to the recording material S is carried out. Thus, the toner images on the recording material S are made into a full color recorded image. Thereafter, the recording material S is discharged to a discharge tray 20.

Meanwhile, toner that remained on the photosensitive drums 3*a*, 3*b*, 3*c* and 3*d* is cleaned off by the photosensitive drum cleaners 4*a*, 4*b*, 4*c* and 4*d* that comprise a cleaning member such as a fur brush or blade means.

Further, in the downstream region in the direction of movement of the transferring belt 21 from the position of separation of the recording material S from the transferring belt 21, a transferring belt cleaner 22 is continuously contacted against the transferring belt 21 as transferred member cleaning means that cleans fog toner or scattered toner that adhered to the surface of the transferring belt 21. Toner that adhered to the transferring belt 21 is cleaned off by the belt cleaner 22 such as a fur brush or blade means.

In this connection, naturally it is also possible to form a monochromatic or multicolor image using the image forming portion for a desired single color, for example, a black monochromatic image, or for several colors among the four colors.

(Configuration and Operation of Developing Device)

Next, the developing device 1 will be described in further detail referring to FIG. 2. In this embodiment the first to fourth image forming portions Pa, Pb, Pc and Pd have substantially the same configuration and perform substantially the same operation as each other, except that the color of the toner image that each portion forms is different. Accordingly, hereunder, when it is not necessary to differentiate between the image forming portions Pa, Pb, Pc and Pd, the subscripts a, b, c, and d that are attached to the symbol "P" to indicate that an element belongs to a particular image forming portion are omitted and a general description is given.

Figure 2:
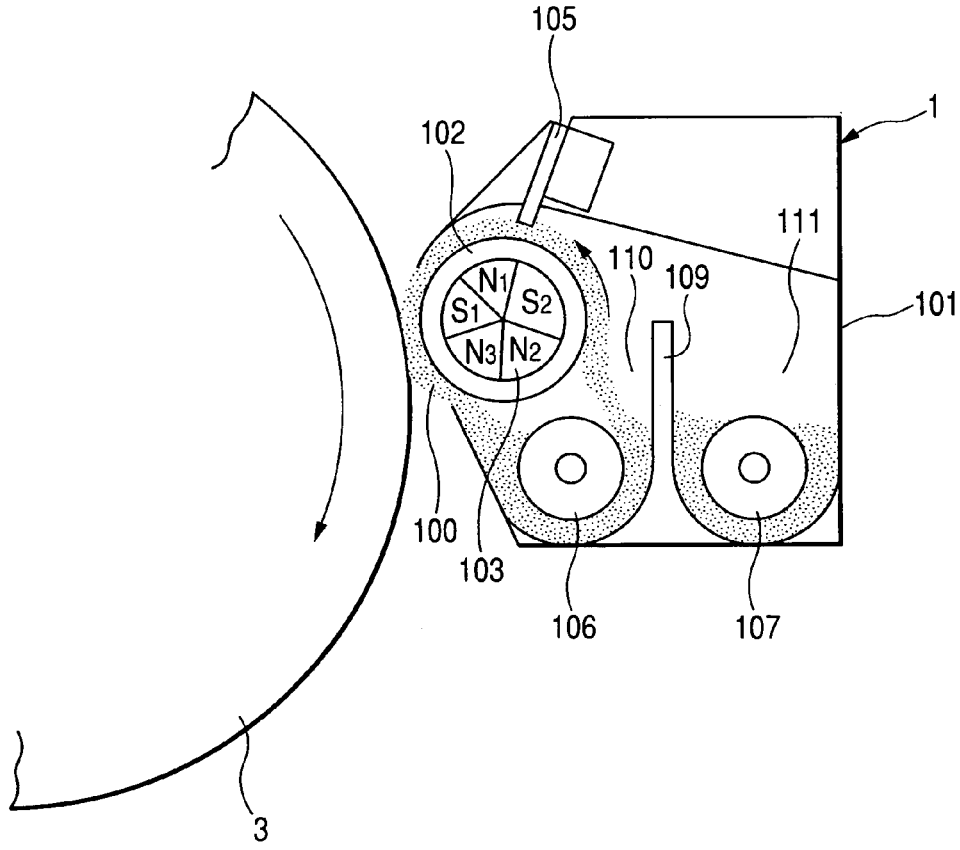
FIG. 2 is a schematic cross section showing the configuration of a developing device comprised by the image forming apparatus of FIG. 1.

As shown in FIG. 2, a developing device 1 that is disposed facing a photosensitive drum 3 comprises, inside a developing container 101, a developing sleeve 102 as a developer carrying member, a fixed magnet roller (magnet) 103 as magnetic field generation means that is disposed inside the developing sleeve 102, a regulating blade 105 as developer amount regulating means that is disposed for forming a thin layer of developer on the surface of the developing sleeve 102, and, as described later herein, first and second developer conveying means 106 and 107 as developer conveying means that agitate and carry developer within the developing container 101.

The inside of the developing container 101 is divided into a developing chamber (first chamber) 110 and an agitating chamber (second chamber) 111 by a partition wall 109 that extends in a vertical direction. The upward portion of the partition wall 109 is open. The developing chamber 110 and the agitating chamber 111 contain a two-component developer comprising a non-magnetic toner and a magnetic carrier.

Figure 4:
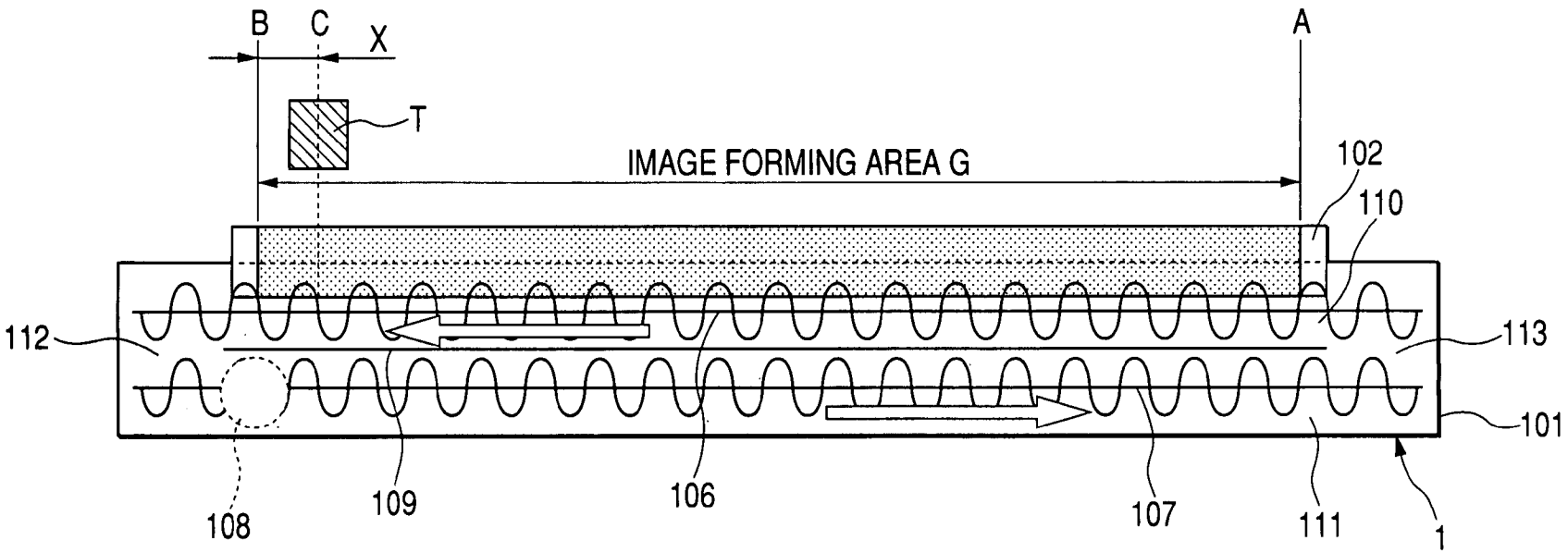
FIG. 4 is an outline cross-sectional plane view of a developing device to illustrate the relation between developer circulation inside a developing container and a thrust position in which a patch image is formed.

In the developing chamber 110 and the agitating chamber 111 are respectively disposed a first developer conveying means (first screw) 106 and a second developer conveying means (second screw) 107 that are of a screw type. The first screw 106 agitates and carries the developer inside the developing chamber 110. Further, when toner is supplied from a toner replenishing container 15 (FIG. 1) through a toner replenishing port 108 (FIG. 4), the second screw 107, under the control of an auto toner replenisher (ATR), carries the supplied toner and agitates it with the developer that is already in the agitating chamber 111 to make the toner density uniform. The toner replenishing port 108 is provided near the upstream side in the direction in which developer is carried by the second screw 107 inside the agitating chamber 111 (FIG. 4). This is to allow toner that was replenished through the toner replenishing port 108 to be agitated and mixed adequately with the developer inside the agitating chamber 111 by the second screw 107 before being carried to the developing chamber 110.

In the partition wall 109, at the edge between the front side and the rear side in FIG. 2, developer passages 112 and 113 (FIG. 4) are formed that interconnect the developing chamber 110 and the agitating chamber 111. Accordingly, by the carrying forces of the first screw 106 and the second screw 107, developer inside the developing chamber 110 in which toner density decreased due to consumption of toner in the developing process moves into the agitating chamber 111 through the developer passage 112 (front side of page space in FIG. 2). Further, developer inside the agitating chamber 111 into which toner was replenished and then agitated moves into the developing chamber 110 through the other developer passage 113 (rear side of page space in FIG. 2).

In the developing chamber 110 of the developing device 1, a position corresponding to a developing area facing the photosensitive drum 3 forms an opening, and the developing sleeve 102 is disposed in a rotatable condition such that one portion thereof is exposed in this opening portion 100 of the developing container 101. In this embodiment, the developing sleeve 102 is composed of a non-magnetic material, and at the time of a development operation it rotates in the direction indicated by the arrow in the figure. Further, a magnet roller 103 as a magnetic field generation means is fixed inside the developing sleeve 102. The developing sleeve 102 carries the layer of two-component developer whose thickness was regulated by the regulating blade 105, and supplies the toner of the developer to the photosensitive drum 3 in the developing area facing the photosensitive drum 3 to develop a latent image as a toner image. In this embodiment, the regulating blade 105 is composed of a non-magnetic material such as SUS, and is disposed in a position that is further upstream in the direction of rotation of the developing sleeve 102 than the photosensitive drum 3. The regulating blade 105 regulates the thickness of developer carried to the developing area on the developing sleeve 102 by regulating the clearance between itself and the surface of the developing sleeve 102. Both the non-magnetic toner and the magnetic carrier pass through the space between the tip of the regulating blade 105 and the developing sleeve 102 and are carried to the developing area.

Further, in order to increase the development efficiency, that is, the ratio of toner imparted onto the latent image, normally a developing bias voltage that superimposes a direct-current voltage and an alternating voltage is applied to the developing sleeve 102 from a developing bias power source as voltage applying means.

The first screw 106 is disposed at the bottom part within the developing chamber 110 in an almost parallel condition to the axial direction (developing width direction) of the developing sleeve 102. In this embodiment, the first screw 106 has a screw structure in which a blade member is provided in a spiral form around the rotational axis, and by rotation thereof the developer inside the developing chamber 110 is carried in one direction along the axial direction of the developing sleeve 102.

In this embodiment, the second screw 107 has a similar screw structure to the first screw 106. More specifically, the second screw 107 forms a screw structure in which a blade member is provided in a spiral form in an inverse direction to the first screw 106 around the rotational axis, and is provided in a roughly parallel condition to the first screw 106 inside the agitating chamber 111 at the bottom thereof. The second screw 107 rotates in the same direction as the first screw 106 to carry developer that is inside the agitating chamber 111 in a direction opposite to that of the first screw 106.

As described above, by the rotation of the first screw 106 and the second screw 107, developer circulates between the developing chamber 110 and the agitating chamber 111.

The developing process that visualizes the aforementioned electrostatic latent image formed on the photosensitive drum 3 by a two-component magnetic brush method using the developing device 1 and the system of circulation of the developer are described hereunder. First, in the process of being carried to the positions of magnetic poles S2 and N1 of the magnet roller 103, developer that was drawn to the developing sleeve 102 at the position of a magnetic pole N2 of the magnet roller 103 accompanying rotation of the developing sleeve 102 is regulated by the regulating blade 105 that is disposed at a predetermined clearance with respect to the developing sleeve 102 (S-B gap). As a result, a thin layer of developer is formed on the developing sleeve 102.

When developer that was carried as a thin layer on the developing sleeve 102 is carried to the position of a developing pole S1 of the magnet roller 103, a magnetic brush (shaped like an ear of grain) is formed by magnetic force. By bringing this magnetic brush formed in a shape like an ear of grain into contact with or adjacent to the photosensitive drum 3, the electrostatic latent image on the photosensitive drum 3 is developed. Thereafter, developer that remains on the developing sleeve 102 after development of the latent image is collected inside the developing container 101 through the repulsive magnetic fields of magnetic poles N3 and N2.

In this embodiment, as the magnetic carrier, a ferrite magnetic carrier that has a weight-average particle diameter of 50 μm, a saturation magnetization of 24 $Am^2/kg$ with respect to an applied magnetic field of 240 kA/m, and specific resistance of $1\times10^{7-8}$ Ω·cm at an electric field intensity of 3000 V/cm is used. Further, as the non-magnetic toner, negatively charged polyester resin toner with a weight-average particle diameter of 7.2 μm composed of colored resin particles to which hydrophobic colloidal silica was externally attached is used. In this embodiment a substance in which the magnetic carrier and non-magnetic toner are mixed to have a weight ratio of magnetic carrier to non-magnetic toner of 93:7 is used as the developer.

In this connection, as the magnetic carriers there may be used resin magnetic carriers prepared by a polymerization method employing binder resin, magnetic metallic oxide and non-magnetic metallic oxide as starting material. A method for preparing these magnetic carriers is not particularly limited. Further, as the non-magnetic toner, styrene acrylic resin toner may be used.

(Auto Toner Replenisher)

Next, the auto toner replenisher (ATR) of this embodiment will be described.

As shown in FIG. 1, the image forming apparatus A has a control portion 60 that conducts unified control of the operation of the image forming apparatus. The control portion 60 has a CPU 61 that functions as the central control element (control means). To the CPU 61 are connected a RAM 62 used as a working memory, a ROM 63 on which programs executed by the CPU 61 and various data are stored, and a test pattern generator 64 as control image generating means that generates image information signals of an image for image density control (patch image). The test pattern generator 64 may also be housed inside a video controller (not shown in the figure).

The video controller converts image information signals from the original reading portion 70 or from an external device that is connected to the main body of the apparatus in a condition enabling communication therewith, to signals relating to image formation in the image forming apparatus A. Based on signals relating to image formation from the video controller, the CPU 61 of the control portion 60 controls the operation of each portion of the image forming apparatus A. As a result, the image forming apparatus A can form and output recorded images. Further, based on a control program stored on the ROM 63 or the like, the CPU 61 controls each portion of the image forming apparatus A to form a patch image in accordance with a signal from the test pattern generator 64. Furthermore, the CPU 61 functions as image density control means that conducts image density control in accordance with the result obtained for detection of the density of the patch image. That is, according to this embodiment, the CPU 61 manages a control function in an auto toner replenisher (ATR) that regulates the toner replenishment amount to the developing devices 1*a*, 1*b*, 1*c* and 1*d* to control the toner density of the developer.

In this invention, the auto toner replenisher (ATR) forms a patch image on the transferring belt 21 by forming a latent image of an image for image density control (patch image) at a predetermined timing on the photosensitive drum 3 that is separate to the normal image formation, and after developing that latent image, transferring the image to the transferring belt 21. The auto toner replenisher then detects the image density of the patch image using an image density sensor 41 as image density detection means that is provided in a position facing the transferring belt 21, and controls the replenishment of toner to the developing device 1 from the toner replenishing container 15 in accordance with the result (patch detection ATR).

The image density sensor 41 is, in brief, a device using a light reflection detection method that has a light emitting portion that irradiates a detecting light towards the patch image and a light receiving portion that receives reflected light from the patch image. Any available device can be used as the image density sensor 41, and in this embodiment the light emitting portion comprises a light emitting diode (LED) as a light source and the light receiving portion comprises a photoconductor diode (PD) as a light receiving element. The image density sensor 41 is provided facing the transferring belt 21 at a position that is further downstream than the photosensitive drum 3*d* of the fourth image forming portion Pd that is disposed in the position furthest downward among the photosensitive drums 3*a* to 3*d* in the direction of movement of the transferring belt 21.

More specifically, first, the test pattern generator 64 generates an image information signal for a reference patch latent image to produce a predetermined contrast voltage, and the CPU 61 controls each portion of the image forming apparatus A in accordance with this signal. Thus, the image forming apparatus A forms a reference patch latent image on the photosensitive drum 3*a* to 3*d* and develops this. In this embodiment, the contrast voltage of the reference patch latent image is 120 V for yellow (Y), magenta (M) and cyan (C), and the contrast voltage of the reference patch latent image is 100 V for black (Bk). As the contrast voltage of the reference patch latent image, it is preferable to select a value through which a difference in the density of the patch image with respect to a variation in the T/D ratio is noticeably manifested. Each of the aforementioned contrast voltages are values at which a difference in a patch image T with respect to a variation in the T/D ratio is manifested most noticeably in the image forming apparatus A of this embodiment. In this connection, the term "contrast voltage" in this embodiment refers to the potential difference between the latent image potential of the photosensitive drum and the direct-current component of the developing bias.

Figure 3:
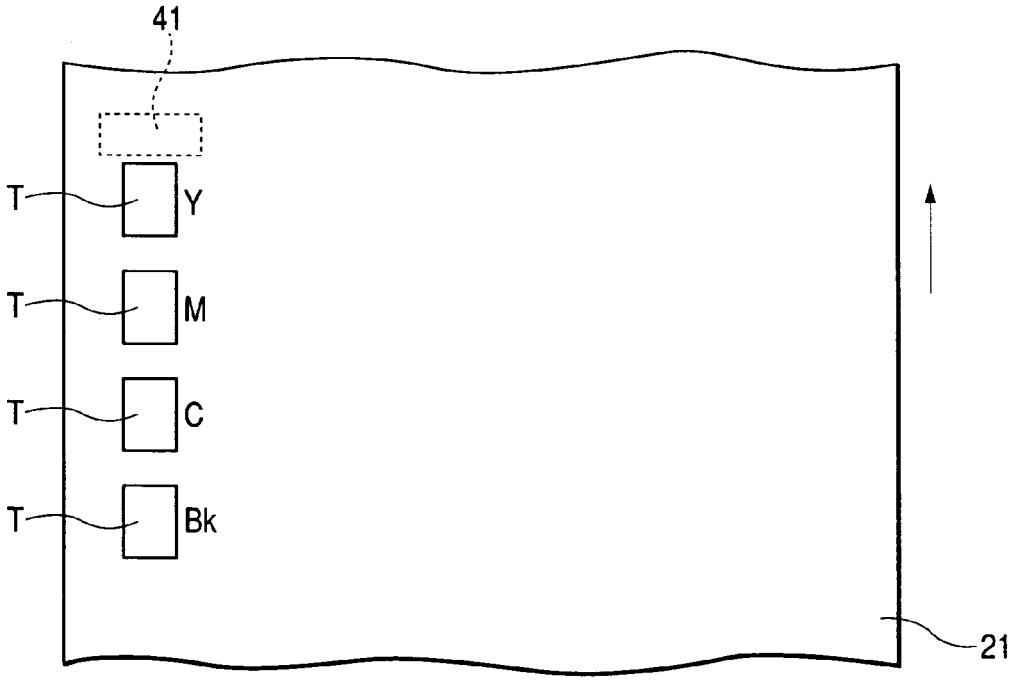
FIG. 3 is a schematic diagram illustrating a patch image used in controlling the toner density of developer.

The CPU 61 then transfers the patch images T that were formed on the photosensitive drums 3*a*, 3*b*, 3*c* and 3*d* of the respective image forming portions Pa, Pb, Pc and Pd in the above-described manner to the transferring belt 21. Thus, the patch images T as shown in FIG. 3 are formed on the transferring belt 21.

Thereafter, in this embodiment the density of the patch images T of yellow, magenta, cyan and black are detected with the single image density sensor 41. That is, the image density sensor 41 irradiates a detecting light on the patch images T using an LED (not shown in the figure) that is provided therein, and detects the amounts of reflected light in sequence. The detection output of the image density sensor 41 is then input into the CPU 61. Based on the detection result of the image density sensor 41, the CPU 61 functioning as image density control means detects the toner density in the developer based on the density level of the patch images T. Then, in accordance with the detected toner density, as described later, the CPU 61 controls the replenishment of toner to each of the developing devices 1*a*, 1*b*, 1*c* and 1*d*.

More specifically, if the density of the patch image T is low, the CPU 61 determines that the toner density in the developer is low, i.e. the T/D ratio is low, and toner replenishment is conducted. In contrast, if the patch image density is high, the CPU 61 determines that the toner density in the developer is high, i.e. the T/D ratio is high, and toner replenishment is not conducted. That is, in the case of using a two-component developer, when the toner density of the developer, i.e. the T/D ratio, is high the image density is high. When the density of the patch images on the transferring belt 21 is high, the image density sensor 41 indicates a gradually increasing trend in the detection output for the toner of yellow, magenta and cyan, and indicates a gradually decreasing trend in the detection output for black toner. Thus, because the image density changes when the toner density, i.e. the T/D ratio, of the developer changes, and further, the detection output of the image density sensor 41 changes, it is possible to control the toner density of the developer, and by extension the density of a formed image, in accordance with the detection result of the image density sensor 41.

In accordance with instructions of the CPU 61 functioning as image density control means, toner replenishment is regulated by a regulating device (not shown in the figure) by determining how much of the toner inside hoppers 15*a*, 15*b*, 15*c* and 15*d* to replenish into the developing devices 1*a*, 1*b*, 1*c* and id. According to this embodiment, by regulating the driving amount of carrying means such as a screw or the like as a regulating device that carries toner to the developing devices 1*a*, 1*b*, 1*c* and 1*d* from hoppers 15*a*, 15*b*, 15*c* and 15*d* in accordance with the developer T/D ratio for each of the developing devices 1*a*, 1*b*, 1*c* and 1*d* that were subject to detection, the CPU 61 replenishes a predetermined amount of toner into the developing device 1. Typically, by performing toner replenishment so that the density of a predetermined patch image is constant, the toner density of the developer can be made constant and a desired image density can be obtained.

In this connection, after the patch image T has been read it is cleaned off the transferring belt by the transferring belt cleaning blade 22.

Further, the driving of the developing sleeve 102 of the developing device 1 stops after the patch image T is formed, and when the next image formation operation starts the driving of the developing sleeve 102 restarts. This is to prevent the acceleration of developer degradation due to stress applied to the developer by idle rotation of the developing sleeve 102 in the form of continued driving thereof when density detection of the patch image T or patch image cleaning is being performed. Further, at this time, since the developer circulation will change, driving of the first screw 106 and the second screw 107 is also stopped.

In patch detection ATR, normally the patch image T is formed at a non-image formation time that is other than a time when an image is being formed to be recorded on a recording material S for output, such as at a timing that corresponds with a space (space between sheets) between a recording material S and a recording material S during a series of image formation operations (job: a series of image formation operations for one or a plurality of recording materials in accordance with one image formation instruction) or at the time of a preparation operation prior to or after image formation (pre-rotation time, post-rotation time) or the like.

As described in the foregoing discussion, in this embodiment the photosensitive drums 3*a*, 3*b*, 3*c* and 3*d*, the charging devices 2*a*, 2*b*, 2*c* and 2*d*, the exposing apparatuses 6*a*, 6*b*, 6*c* and 6*d*, the developing devices 1*a*, 1*b*, 1*c* and 1*d* and the transfer charging devices 5*a*, 5*b*, 5*c* and 5*d* of each of the image forming portions Pa, Pb, Pc and Pd, as well as the test pattern generator 64 and the CPU 61 and the like comprise control image formation means that forms a patch image T on the respective photosensitive drums 3*a*, 3*b*, 3*c* and 3*d* and then transfers the patch image T to the transferring belt 21. Further, an auto toner replenisher (ATR) is composed by this control image formation means, the image density sensor 41 as image density detection means, the CPU 61 as image density control means and the like.

(Patch Image Formation Position)

Next, referring to FIG. 4, the relation between developer circulation within the developing container 101 and the formation position of a patch image (patch image formation position) in the thrust direction (direction roughly perpendicular to the direction of movement of the surface of the transferring belt, the developing sleeve and the photosensitive drum) is described. In FIG. 4, developer circulates in a counterclockwise direction inside the developing container 101. Toner is replenished from the toner replenishing port 108 into the developing container 101. As described in the foregoing discussion, the toner replenishing port 108 is provided near the upstream edge in the direction in which developer is carried by the second screw 107 inside the agitating chamber 111.

The image formation area, more specifically, the area in the thrust direction in which toner is supplied from the developing sleeve 102 to the photosensitive drum 3 is the space between position A and position B in FIG. 4. That is, the image formation area is the area in the thrust direction from position A (image formation area maximum upstream position) at one end of the developing sleeve 102 near the upstream edge in the direction in which developer is carried inside the developing chamber 110 by the first screw 106, to position B (image formation area maximum downstream position) at the other end of the developing sleeve 102 in the vicinity of the downstream edge.

The patch image T is formed in a position C (patch image formation position) that is X mm upstream from the image formation area maximum downstream position B, and density detection is conducted at this position C.

Here, as described in the foregoing discussion, patch detection ATR forms a patch image T in a space between sheets or the like at a non-image formation time, and then detects the density of the patch image T and replenishes the toner. However, for example, in a configuration which forms a patch image T in the center part of the image formation area in the thrust direction and then detects that patch with an image density sensor, as is generally employed by conventional apparatuses, the patch image T is carried as far as the position of the toner replenishing port (toner replenishing position) after toner has been further consumed from the state of the developer at the time the patch image T was formed. As a result, an error occurs in the adjustment by patch detection ATR.

Although this problem is comparatively small when the next image formation job after conducting patch detection ATR is the formation of an image on a small-size recording material S or formation of an image with a small image ratio, the problem becomes noticeable when the next image formation job after conducting patch detection ATR is, for example, the formation of an image on a large-size recording material S or formation of an image with a high image ratio, since a large amount of toner is consumed in the period between the time the developer formed the patch image T and the time toner is actually replenished at the toner replenishing port position. The larger this error, the greater the change in the T/D ratio and the greater the fluctuation in the toner density of the developer and the image density becomes.

Thus, after formation of the patch image T, it is desirable that toner is replenished in a state in which toner consumption is not further performed after the developer formed the patch image T.

Therefore, in this embodiment, the distance X from the image formation area maximum downstream position B to the patch image formation position C is decided as described in the following discussion in accordance with this invention.

Figure 5:
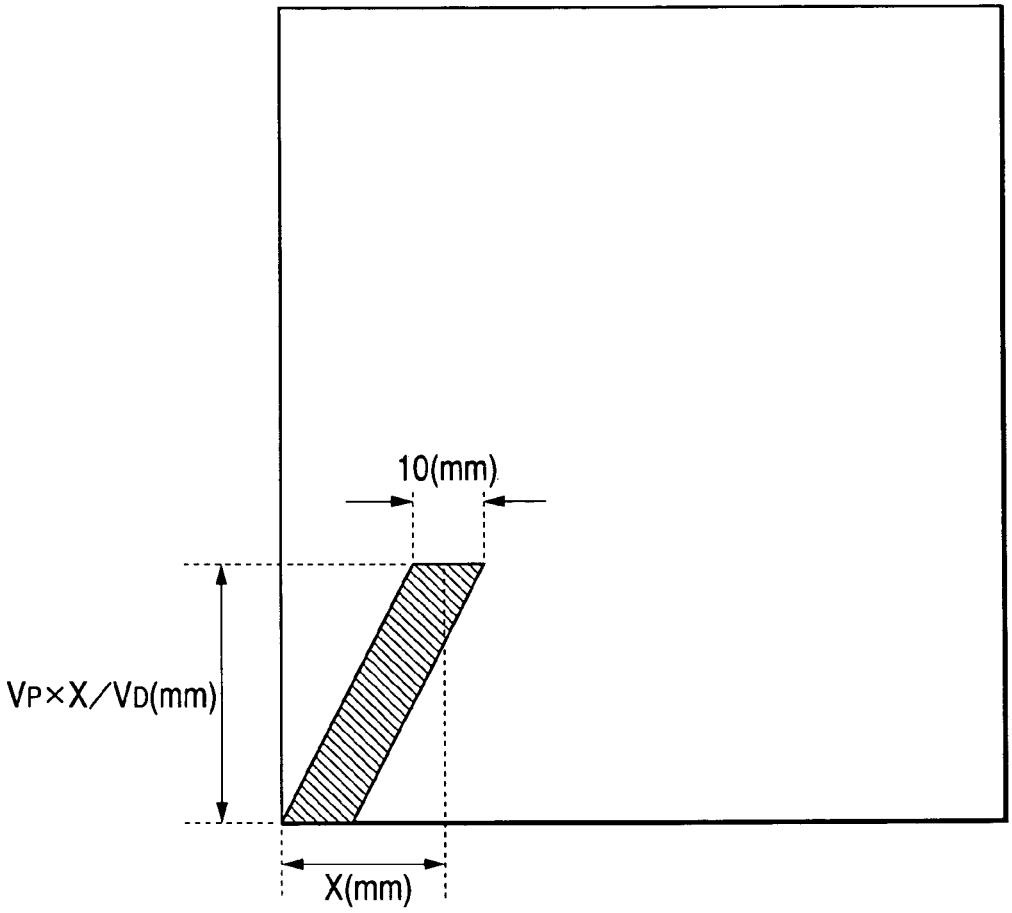
FIG. 5 is a view showing the toner consumed when a solid image was formed.

When the developer amount at a position facing the developing sleeve 102 inside the developing container 101, that is, the developer amount per a predetermined length (in this case, 10 mm) inside the developing chamber 110, is taken as Y (g), the carrying speed of developer at a position facing the developing sleeve 102 inside the developing container 101 is taken as $V_D$ (mm/s), the toner carrying amount per unit area at the time of formation of a solid image is taken as M (mg/cm$^2$), the process speed is taken as $V_P$ (mm/s), the T/D ratio is taken as W (%), and the distance in the thrust direction from the image formation area maximum downstream position B to the patch image formation position C is taken as X (mm), since the toner amount Z (mg) consumed from the developer per a predetermined length (10 mm) by formation of a solid image after formation of the patch image T is the toner amount that develops the shaded area shown in FIG. 5, then $$Z\ (\text{mg}) = M \times 0.01\ [\text{mg/mm}^2] \times \{10\ [\text{mm}] \times V_P\ [\text{mm/s}] \times (X\ [\text{mm}]/V_D\ [\text{mm/s}])\} = M \times X \times V_P / 10\ V_D \quad (1)$$

and the error ΔT/D ratio (%) in the developer T/D ratio due to toner consumption is $$\begin{aligned} \Delta T/D\ \text{ratio}\ (\%) &= W - \{(Y \times 1000\ [\text{mg}] \times W/100 - Z\ [\text{mg}])/(Y \times 1000\ [\text{mg}] \times W/100)\} \times W \\ &= W\{1 - (Y \times W \times 10 - Z)/(Y \times W \times 10)\} \\ &= Z/(10 \times Y) \\ &= (M \times X \times V_P)/(100 \times Y \times V_D) \end{aligned} \quad (2)$$

FIG. 5 is a view that schematically shows the toner amount that transfers from the developing container 101 onto the photosensitive drum 3 via the developing sleeve 102 when a solid image is formed.

In this connection, the above-described term "time of formation of a solid image" refers to the state at the time a latent image of a contrast such that the maximum density (maximum toner carrying amount) is output was formed on an image bearing member (state of a so-called black solid copy) and then developed with toner. In other words, it refers to the time of formation of a maximum density image.

Further, the above-mentioned term "image formation area" refers to an area corresponding with the maximum latent image area in the longitudinal direction of an electrostatic image formed on the photosensitive drum 3. More specifically, it is the maximum area in which development is possible with respect to the maximum latent image area.

The term "position facing the developing sleeve 102 inside the developing container 101" refers to the position at which the toner density of the developer therein begins to decline when the developer therein is supplied to the developing sleeve 102 at the time of the developing process. In this embodiment, it refers to an area facing the developing sleeve 102 within the developing chamber 110.

The developer amount Y (g) per predetermined length (10 mm) of a position facing the developing sleeve 102 inside the developing container 101 is measured as follows. The amount of developer in an area that faced the developing sleeve 102 of the developing chamber 110 is measured, and the developer amount Y is then calculated by dividing the measured amount of developer by the length of the developing sleeve 102.

The carrying speed of developer $V_D$ (mm/s) at a position facing the developing sleeve 102 inside the developing container 101 is measured as follows. Toner of another color is replenished into the developing device 1, and the carrying speed $V_D$ (mm/s) is measured based on the distance that the toner moves on the image.

The term "solid image" refers to an image of the maximum density gradation level that can be formed by the image forming apparatus. The toner carrying amount per unit area at the time of formation of a solid image M ($mg/cm^2$) is measured as follows. The weight of a toner image developed on the photosensitive drum 3 is measured prior to conducting transfer, and the toner carrying amount per unit area M ($mg/cm^2$) is calculated by dividing the obtained result by the area.

In this embodiment, the process speed $V_P$ (mm/s) corresponds to the surface movement velocity (circumferential velocity) of the photosensitive drum 3.

Further, the term "patch image formation position C" refers to the position of a patch image that is in an area in which the density of the patch image can be detected by the image density sensor 41. Normally, the distance X between the image formation area maximum downstream position B and the patch image formation position C is represented by the distance between the center of the patch image T in the thrust direction and the image formation area maximum downstream position B.

Hereafter, color differences and image density fluctuations at the time of an error in the T/D ratio will be described. In particular, the case of the color magenta is described.

Figure 6:
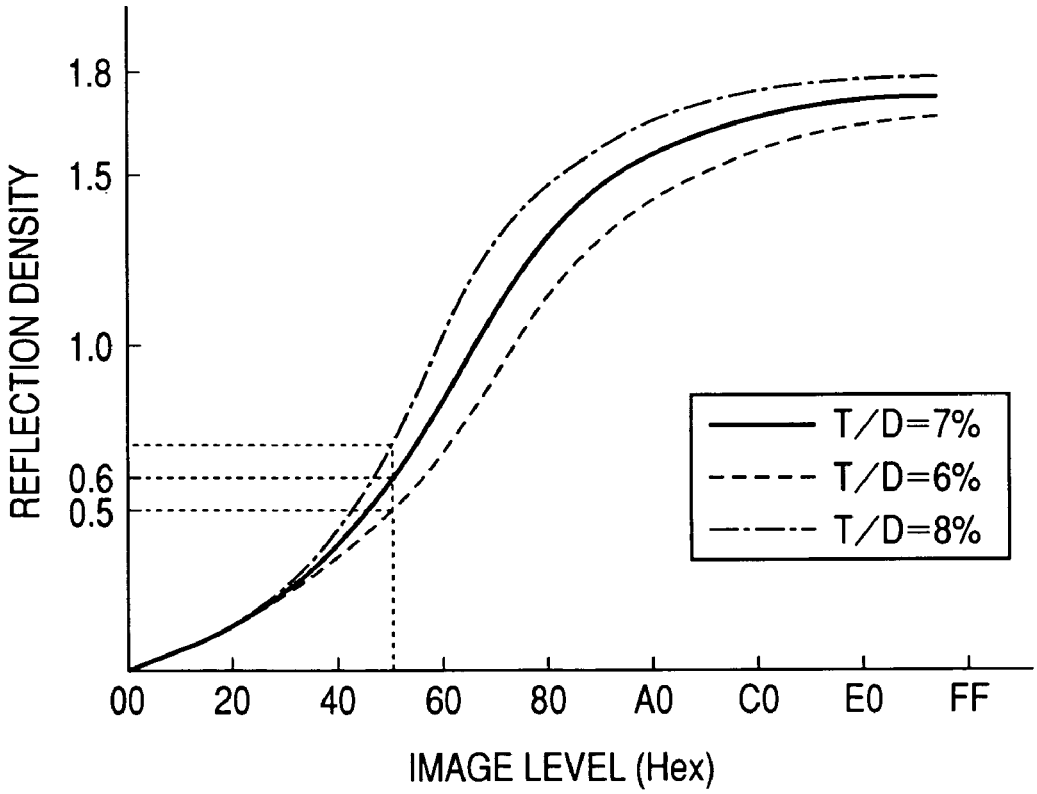
FIG. 6 is a graph showing the relation between image level and output reflection density with respect to changes in the T/D ratio.

FIG. 6 shows the relation between image level and reflection density of an output image with respect to changes in the T/D ratio (ΔT/D ratio). In the image forming apparatus A of this embodiment, the gradation in image formation is composed of 256 levels (00h to FFh).

The halftone density for measuring variations (ΔD) in the image density is level 60 of the image levels (gradation levels) (Hex). At this time, if the T/D ratio of the developer is a normal value (in this embodiment, 7%) the image density (reflection density) is 0.6 when measured with a reflection densitometer (X-Rite). This is because, of the changes in color due to image density fluctuations, the halftone image density fluctuations are easily noticed by the human eye.

As shown in FIG. 6, fluctuations in the T/D ratio have a large impact on halftone image density fluctuations, and for a 1% fluctuation in the T/D ratio there is about a 0.1 change in the halftone density (0.6 at a normal T/D ratio).

Further, for a density of 0.6, when a difference in the image density fluctuation ΔD is 0.045 the color difference ΔE=3, when ΔD is 0.06 the color difference ΔE=4, and when ΔD is 0.08 the color difference ΔE=5.

The color difference ΔE was determined in the following manner. The value for chromaticity L*a*b was measured for an output image with the color reflection spectrodensitometer X-Rite 530 (manufactured by X-Rite), and the color difference ΔE was calculated by the following formula.

$$\text{color difference}\Delta E=\sqrt{(\Delta L)^2+(\Delta a)^2+(\Delta b)^2} \quad \text{(Formula 1)}$$

When the value of this color difference ΔE exceeds 3, tint variations are easily noticeable when viewed by the human eye. Accordingly, in order to realize a superior quality image forming apparatus that produces few tint variations, it is preferable to control the color difference ΔE to a value that is equal to or less than 3.

Table 1 shows the relation between the distance X and fluctuations in the T/D ratio (ΔT/D ratio) as well as the variation (ΔD) in the halftone image density at a time when only the distance X in the configuration of this embodiment is changed and a solid image is formed immediately after the patch image T was formed, and toner replenishment was performed based on the detection result for the patch image T. The values for ΔD and ΔE in Table 1 are the differential values with respect to the values when the T/D ratio was controlled as intended.

TABLE 1

| X(mm) | ΔT/D ratio (%) | image density fluctuation ΔD | color difference ΔE |
|---|---|---|---|
| 10 | 0.09 | 0.01 | 0 |
| 30 | 0.26 | 0.03 | 2 |
| 50 | 0.43 | 0.04 | 2.8 |
| 51.8 | 0.45 | 0.042 | 3.0 |
| 70 | 0.61 | 0.06 | 3.5 |

The aforementioned parameters in this embodiment are:

Y=4.5 (g)

$V_D$=18 (mm/s)

M=0.64 ($mg/cm^2$)

$V_P$=110 (mm/s)

W=7 (%)

In this embodiment, the length G of the image formation area is 303 mm, the length in the thrust direction of the developing chamber 110 and the agitating chamber 111 is 325 mm, respectively, and the distance (1 circulation) that the developer circulates inside the developing container 101 is approximately 650 mm.

More specifically, it has been found that in order to make the color difference ΔE equal to or less than 3 and the difference in the image density fluctuation ΔD equal to or less than 0.045, it is desirable to make the fluctuation in the T/D ratio equal to or less than 0.45%. Thus, from the above-described equation (2), it is necessary to satisfy the relation of:

ΔT/D ratio (%)=$(M\times X\times V_P)/(100\times Y\times V_D)\leqq 0.45$. More specifically, at this time, it is necessary that the distance X (mm) from the image formation area maximum downstream position B to the patch image formation position C satisfies the following equation:

$$X\leqq(45\times Y\times V_D)/(M\times V_P) \quad (3)$$

That is, at an area past the formation position of the patch image T in the developer carrying direction at a position facing the developing sleeve 102 inside the developing container 101, even when forming a solid image in which the most developer is consumed, the distance X is regulated such that the color difference ΔE is equal to or less than 3.

Thus, from equation (3), according to this embodiment the distance X from the image formation area maximum downstream position B to the patch image formation position C is equal to or less than 51.8 mm. In this embodiment the distance X was set as 40 mm. In this embodiment, the patch image formation position C was the same for each color.

Although the foregoing description was made for the color magenta in particular, with respect to the other colors, according to the studies of the present inventors the color difference fluctuations are conspicuous for cyan at the same level, and the color difference fluctuations for yellow are less with respect to density in comparison to magenta and cyan because yellow has a high level of lightness. Accordingly, by regulating the distance X for yellow also, together with magenta, color difference fluctuations can be controlled. In this connection, by setting the range of the distance X as defined by the above-described equation, not only is it possible to control color difference fluctuations, but it is also possible to control T/D ratio fluctuations to enable the formation of a stable image with substantially no density fluctuations.

In this embodiment, by forming the patch image T within a predetermined range from the image formation area maximum downstream position B, even when forming an image with a high image ratio such as a solid image immediately after the patch image T was formed, a stable T/D ratio and a stable image density can be maintained by the auto toner replenisher (ATR).

According to the configuration of this embodiment, the operational effects described hereunder can also be obtained.

For an apparatus with a configuration in which the length in the thrust direction is comparatively short and the distance in the developer circulating direction from the toner replenishing port 108 to the patch image formation position C is comparatively close, for example an image forming apparatus (A4 copying machine) that is capable of image formation on a recording material S up to A4 size, the following kind of problem may exist. That is, in this kind of configuration, immediately after replenishment of a large amount of toner has been performed, since the distance in which toner is agitated is short, inconsistencies in the developer density can occur and, as a result, the density of the patch image T may not be stable. Thus, a large variation may occur in the image density.

Figure 7:
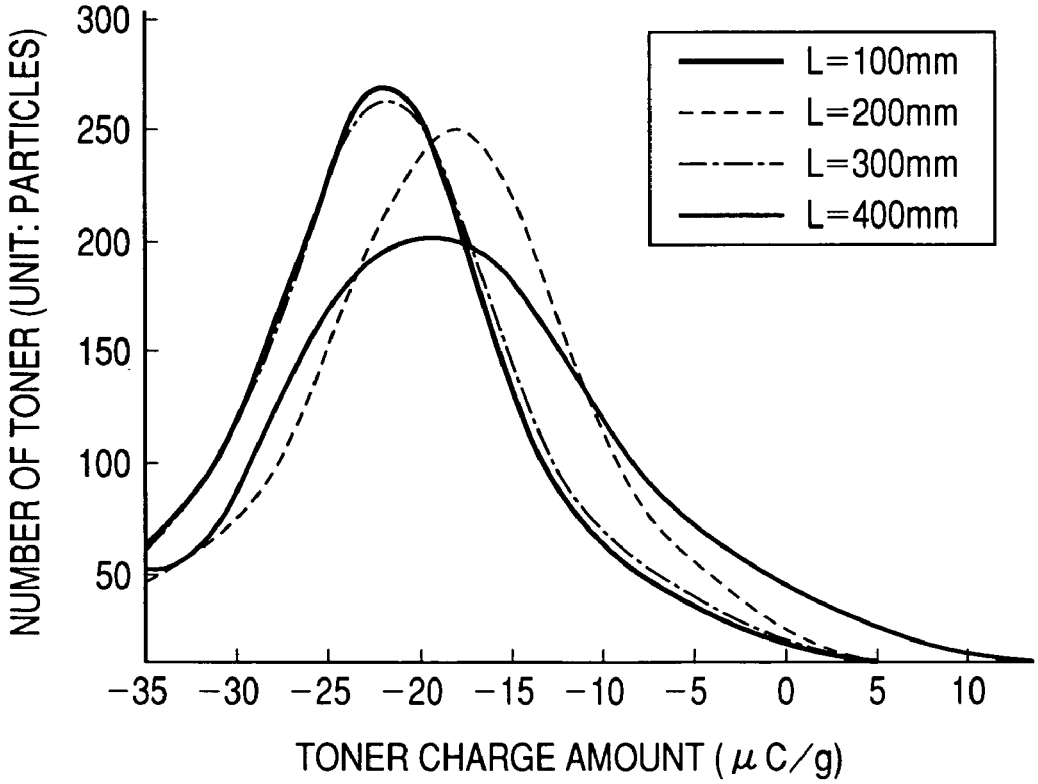
FIG. 7 is a graph showing the relation between toner charge amount distribution and distance from the replenishing port at the time of replenishing a toner amount consumed in formation of a solid image.

FIG. 7 is a view showing the relation between a distance L (mm) from the toner replenishing port 108 to the patch image formation position C in the direction in which the developer circulates and the toner charge amount distribution at that position at the time a toner amount consumed when forming a solid image is replenished from the toner replenishing port 108. Each of the above-described parameters Y (g), $V_D$ (mm/s), M (mg/cm$^2$), $V_P$ (mm/s) and W (%) are the same as indicated in the foregoing discussion. Further, the developer carrying speed on the second screw 107 side, i.e. the developer carrying speed within the agitating chamber 111, is 20 (mm/s).

In this connection, regarding the charge amount distribution of toner, the charge amount of toner was measured by collecting developer on the developing sleeve 102 at the respective distances, blowing toner off with nitrogen gas from the developer that was held by magnetic force to a magnet, and introducing the toner from a sampling hole into a measuring portion (measuring cell) of an Espart Analyzer (product name) manufactured by Hosokawa Micron Corporation that was used as a measurement device. The measurement was conducted until the count reached 3,000 toner particles.

According to this embodiment, the length in the thrust direction of the developing chamber 110 and the agitating chamber 111, and the distance which the developer circulates (1 circulation) inside the developing container 101 are as described in the foregoing discussion, respectively. As shown in FIG. 6, when the distance L is less than a predetermined value (300 mm in this embodiment) the distribution of the charge amount is broad, and irrespective of negative toner, non-charged and normally-charged toner are present in abundance, and the average toner charge amount is also low. That is, this state is one in which, because the agitating distance after conducting toner replenishment is short, the triboelectric charging of the carrier and the toner is inadequate. When a patch image is formed in this state, the density is liable to be unstable. Conversely, when the distance L is equal to or greater than a predetermined value (300 mm in this embodiment), the distribution of the toner charge amount is sharp and the average toner charge amount is also stable. Thus when a patch image is formed in this state the density is also stable.

More specifically, in an image forming apparatus such as an A4 copying machine in which the thrust width is short and agitating distance after replenishing toner is short, the patch image density may become unstable even in the image formation area that is upstream in the developer carrying direction.

In contrast, in this embodiment, since forming the patch image T within a predetermined range from the image formation area maximum downstream position B enables the developer inside the developing container 101 and replenished toner to be mixed adequately in the space from the position of the toner replenishing port 108 to the patch image formation position C in the developer circulating direction, triboelectric charging of the toner can be adequately conducted. As a result, image density control can be stably performed.

When toner replenishment was performed for each of the developing devices 1*a*, 1*b*, 1*c* and 1*d* by an auto toner replenisher (ATR) having the above-described configuration, even at the time of a formation operation for an image with a high image ratio such as a solid image, a stable T/D ratio and stable image density were maintained. Thus, high quality images could be obtained regardless of whether the image ratio was high or low.

Figure 8:
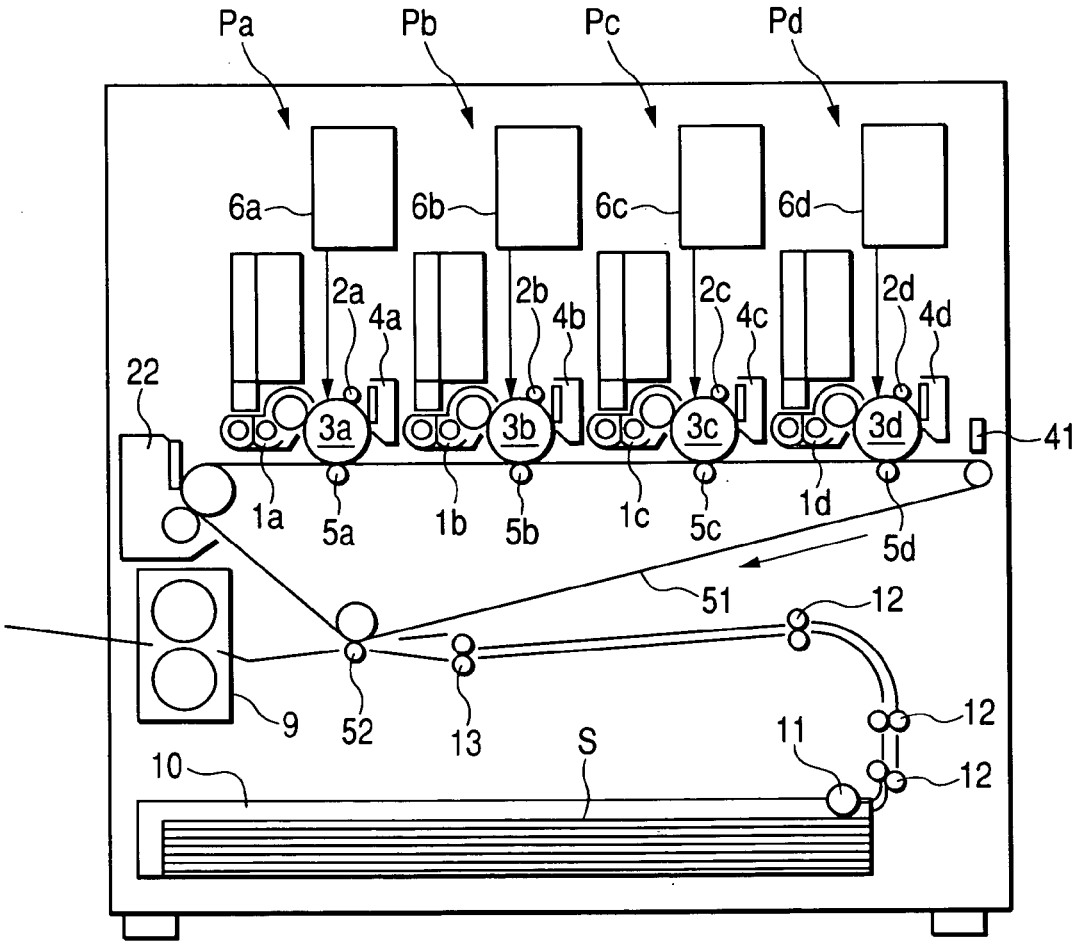
FIG. 8 is a view showing an outline of the overall configuration of another example of an image forming apparatus to which this invention can be applied.

In this connection, in the above-described embodiment, the image forming apparatus A is an apparatus that obtains a recorded image by directly transferring toner images formed with each of the image forming portions Pa, Pb, Pc and Pd onto a recording material S conveyed on the transferring belt 21 as a recording material carrying member. However, this invention is not limited thereto, and it is possible for a person skilled in the art to suitably apply the invention equally to a known intermediate transfer-type image forming apparatus. For example, an intermediate transfer-type image forming apparatus has the type of configuration shown in FIG. 8. In FIG. 8, elements that have substantially the same or a corresponding configuration and function as elements of the image forming apparatus A are denoted by the same symbols as in the image forming apparatus A, and a detailed description thereof is omitted here. More specifically, an intermediate transfer-type image forming apparatus transfers (primary transfer) toner images formed by the respective image forming portions Pa, Pb, Pc and Pd onto an intermediate transferring member (intermediate transferring belt or the like) 51 in sequence by the action of primary transferring means 5*a*, 5*b*, 5*c*, and 5*d*, to form a color toner image in which toners of a plurality of colors are superposed on the intermediate transferring member 51. Subsequently, the image forming apparatus transfers (secondary transfer) the toner image on the intermediate transferring member 51 in one block onto a recording material S by the action of a secondary transfer charging device 52 or the like as a secondary transferring means. Thereafter, a recorded image is obtained by fixing the toner image on the recording material S. In an image forming apparatus of this configuration also, by forming a patch image T on the intermediate transferring member 51 and detecting this with an image density sensor 41 provided facing the intermediate transferring member 51 using a method that is substantially the same as that for forming a patch image T on the transferring belt 21 in the above-described embodiment, toner replenishment to each of the developing apparatuses 1*a*, 1*b*, 1*c* and 1*d* can be controlled.

Accordingly, in this image forming apparatus, the same operational effect can be obtained by setting the patch image formation position C in the same manner as the above-described embodiment.

Although providing the image density sensor 41 in a position facing the transferring belt 21 or the intermediate transferring member 51 allows the patch images T formed by each of the image forming portions Pa, Pb, Pc and Pd to be detected by a single image density sensor 41, and this is thus advantageous with respect to simplification of the configuration of the apparatus and the like, the present invention is not limited thereto. For example, the image density sensor 41 may be provided facing the respective photosensitive drums 3*a*, 3*b*, 3*c* and 3*d* of each image forming portion Pa, Pb, Pc and Pd to detect the density of the patch images T on the photosensitive drums 3*a*, 3*b*, 3*c* and 3*d*. In this configuration also, the same effect as described above can be obtained.

This invention can also be applied to a so-called single drum-type image forming apparatus that comprises a plurality of developing devices for a single image bearing member and forms a color image by forming a multi-toner image comprising toner of a plurality of colors on an image bearing member or by forming toner images of different colors in sequence on an image bearing member and transferring the toner images in sequence onto a recording material on a recording material carrying member or onto an intermediate transferring member. In this case, the density of an image for image density control may be detected on the image bearing member, the recording material carrying member or the intermediate transferring member according to whichever of these is employed as the member for transferring.

Embodiment 2

Next, another embodiment of this invention will be described referring to FIG. 9. The basic configuration and operation of the image forming apparatus of this embodiment is the same as that of Embodiment 1. Accordingly, elements that have substantially the same or a corresponding configuration and function as elements of the image forming apparatus of Embodiment 1 are denoted by the same symbols as in Embodiment 1, and a detailed description of these is omitted here.

An example of a conventional image forming apparatus that forms images by an electrophotographic method such as a copying machine or laser beam printer is a full color image forming apparatus that forms images by superposing images of each color component of yellow, magenta, cyan and black. In a full color image forming apparatus, image density control that regulates the maximum density of images of each color component of yellow, magenta, cyan and black or the halftone density in order to achieve high image quality and carries out control so that images of a constant density can always be obtained without being influenced by individual differences among apparatuses and environmental variations is important for achieving high-quality images.

Therefore, conventionally, in a full color image forming apparatus, density detection is performed at fixed intervals to conduct image density control, and the image density is controlled by controlling image formation conditions such as the developing bias or the exposure of a latent image.

In this embodiment, image density control means detects the density of a patch image T formed in a patch image formation position C that was set in a similar manner to Embodiment 1, and controls the image formation conditions. Naturally, the image density control means is also responsible for the control function of an auto toner replenisher (ATR), and similarly to Embodiment 1, carries out toner replenishment for each of the developing devices 1*a*, 1*b*, 1*c* and 1*d*.

More specifically, although in Embodiment 1 the density level of the patch image T detected by the image density sensor 41 for toner replenishment control was taken as a single gradation level for each color, in this embodiment, in order to control the image formation conditions, a patch image T2 of a plurality of gradation levels for each color is formed on the transferring belt 21. The image formation conditions are then controlled based on the result of detecting the densities of this patch image T2.

Hereunder, the image density control of this embodiment is described in further detail.

Figure 9:
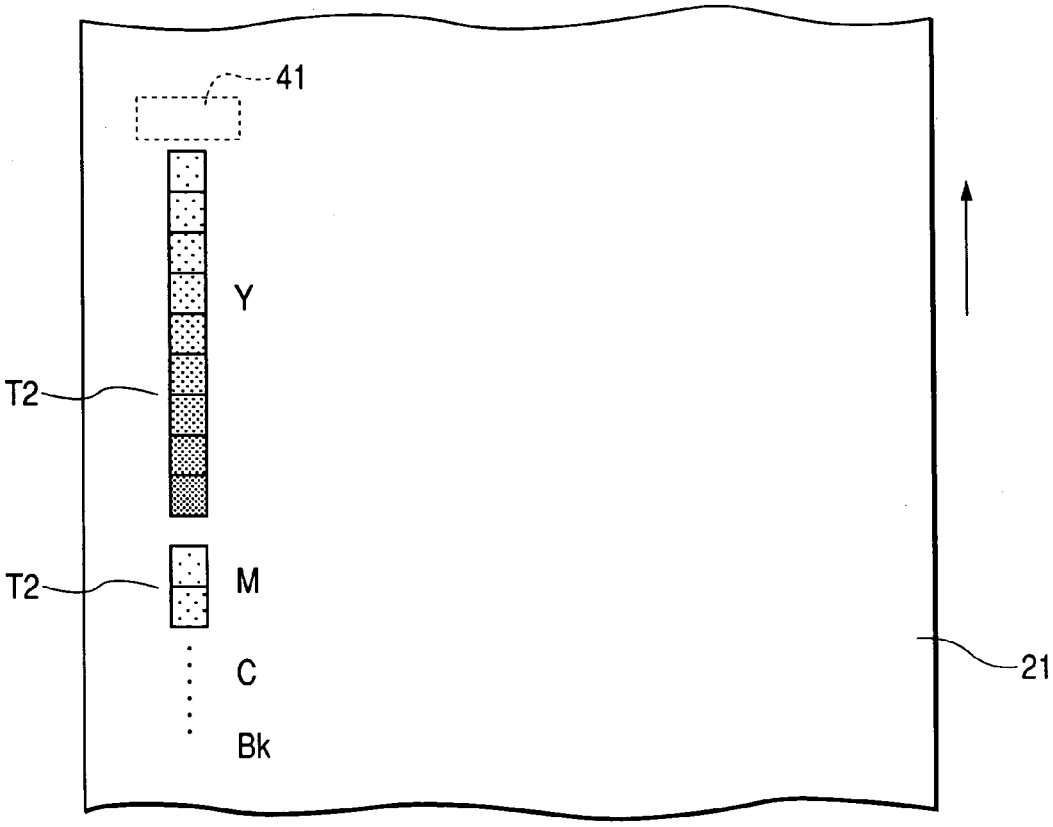
FIG. 9 is a schematic diagram that illustrates a patch image used for controlling image formation conditions.

A patch image T2 as shown in FIG. 9 is formed by the test pattern generator 64 in the image forming apparatus shown in FIG. 1 in a state in which charging conditions, exposing conditions, developing conditions and transferring conditions were set for the photosensitive drums 1*a* to 1*d*.

More specifically, for each color a toner patch image T2 of nine gradations of respectively different latent image conditions (for example, image level (Hex) 10, 20, 40, 60, 80, A0, C0, E0 and FF) is transferred onto the transferring belt 21. Then, detection of the density of each gradient for each color is conducted with the image density sensor 41 that is provided facing the transferring belt 21. An image formation signal relating to the patch image T2 of a plurality of gradations for each color is, in the same manner as Embodiment 1, generated by the test pattern generator 64, and the CPU 61 controls each portion of the image forming apparatus A to form an image at a predetermined position on the transferring belt 61. After completion of the detection, the patch image T2 is removed from the transferring belt 21 by the transferring belt cleaner 22.

The CPU 61 as image density control means then controls the correction control of preset gradation characteristics in accordance with the state of the densities of the patch image T that were detected by the image density sensor 41. Thereby, even if a change occurs in the gradation characteristics, vivid images can be formed stably with the appropriate gradation characteristics.

More specifically, for example, the CPU 61 can correct table values set in a look-up table (LUT), for gradation correction (gradation correction LUT) by use of, for example, a gradation correction LUT, in accordance with the state of the density levels of the patch image T2 that were detected by the image density sensor 41. Thus, the image information signals that are the basis of the image formation operation are corrected. In this way, the gradation characteristics can be automatically changed in real time.

Further, in accordance with the state of the density levels of the patch image T2 that were detected by the image density sensor 41, the CPU 61 can perform correction control sequentially for the charging conditions, exposing conditions, developing conditions and transferring conditions that were preset for each of the photosensitive drums 3*a*, 3*b*, 3*c* and 3*d*. It is thus possible to stabilize image quality by grasping the setting state of the image formation process conditions.

Therefore, for example, it is possible to exhibit favorable density reproducibility in which a linear output image density is reproduced with respect to an input image signal by image density control in accordance with a corrected LUT.

Thus, image formation conditions that are controlled by the image density control means include image formation process conditions such as charging conditions, exposing conditions, developing conditions and transferring conditions as well as adjustment of the gradation correction LUT.

In this connection, various methods are known as a method of controlling the image formation conditions itself, and since any available method can be arbitrarily employed for use in this invention, a further detailed description thereof is omitted herein.

According to this embodiment also, by providing the image density sensor 41 in a similar position as Embodiment 1, image density control can be carried out by forming a patch image T2 with developer having a stable T/D ratio. Thus, it is possible to obtain a high-quality image with a stable density.

Embodiment 3

Figure 10:
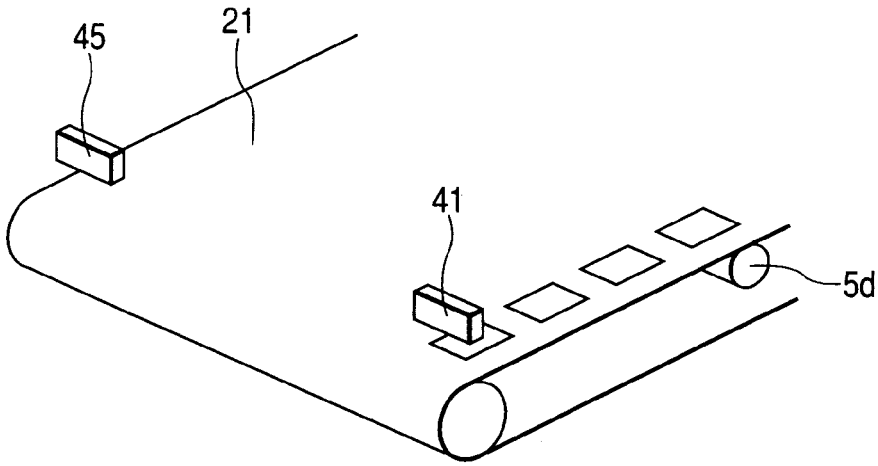
FIG. 10 is a view showing an outline configuration for Embodiment 3 of the image forming apparatus of this invention.
Figure 11:
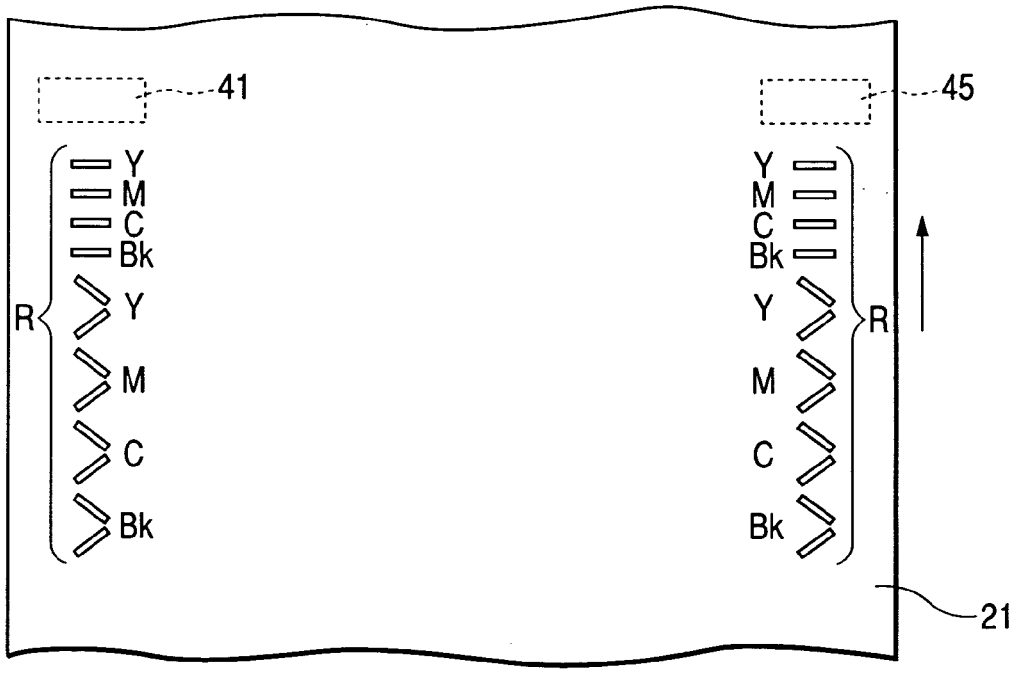
FIG. 11 is a schematic diagram illustrating a registration pattern image used in registration control.

Next, a further embodiment of this invention will be described referring to FIG. 10 and FIG. 11. Since the basic configuration and operation of the image forming apparatus of this embodiment is the same as that of Embodiment 1, elements that have substantially the same or a corresponding configuration and function as elements of Embodiment 1 are denoted by the same symbols as in Embodiment 1, and a detailed description of these is omitted here.

According to this embodiment, the image density sensor (patch detection sensor) 41 for which the position was set in the same manner as Embodiment 1 is employed for dual use as a registration detection sensor that is used in registration (misregistration) correction control.

In this embodiment, as described in the foregoing discussion, the image density sensor 41 is employed for dual use as a first registration detection sensor. Further, a second registration detection sensor 45 is provided near the end of the opposite side to the image density sensor 41 in the thrust direction of the transferring belt 21, such that it faces the transferring belt 21.

A registration pattern image R is formed as an image for registration correction at a position facing the two sensors 41 and 45 on the transferring belt 21. Reflected light from the registration pattern image R is detected by the sensors 41 and 45, and based on the detection result the misregistration amount of images formed by each of the image forming portions Pa, Pb, Pc and Pd is detected. Then, in accordance with that result, correction of the image writing timing is performed for each of the image forming portions Pa, Pb, Pc and Pd. The registration pattern image is generated by the test pattern generator 64. The CPU 61 performs unified control of formation of the pattern for registration correction, reading of a predetermined pattern for registration correction, and registration correction operations based on a control program stored on the ROM 63 or the like. In this connection, after the registration pattern image R has been read, it is cleaned off the transferring belt by the transferring belt cleaning blade 22.

Various methods are known as the registration control method itself, and since any available method can be arbitrarily employed for use in this invention, a further detailed description thereof is omitted herein.

The accuracy of the registration correction increases in accordance with an increase in the distance of separation in the thrust direction between the two sensors at both ends in the thrust direction. This is because the deviation of each color due to inclination appears to a large amount, and thus the correction accuracy is enhanced.

Therefore, in a configuration that sets the distance X from the image formation area maximum downstream position B to the patch image formation position C and provides the image density sensor 41 at the edge of the image formation area to perform control of the toner density of developer (Embodiment 1) or control of image formation conditions (Embodiment 2) in accordance with this invention, the image density sensor 41 is suitable for dual use as a registration detection sensor. Further, when providing a registration detection sensor and an image density sensor separately, as in a conventional image forming apparatus, in comparison with the case of providing two registration pattern detection sensors and a single image density sensor, for example, an equivalent effect can be achieved with a configuration that is lower in cost.

This application claims priority from Japanese Patent Application No. 2004-197395 filed Jul. 2, 2004, which is hereby incorporated by reference herein.

What is claimed is:

1. An image forming apparatus comprising:

an image bearing member on which an electrostatic image is formed;

developing means comprising a developing container which contains developer comprising a carrier and a toner, a developer carrying member which is provided at an opening portion of the developing container and which carries the developer, and a developer conveying member which is disposed inside the developing container and which carries developer in the vicinity of the developer carrying member in a longitudinal direction of the developer carrying member, the developing means developing the electrostatic image on the image bearing member;

wherein, the developing container comprises a first chamber having the opening portion and in which the developer conveying member is disposed, and a second chamber for returning developer that was carried from the first chamber;

control image formation means that forms an image for image density control comprising the toner on the image bearing member;

image density detection means that detects at a predetermined detection position a density of the image for image density control on the image bearing member or on a transferring medium to which an image on the image bearing member is transferred; and image density control means that performs image density control based on a detection result from the image density detection means, wherein, when a developer amount per 10 mm in the longitudinal direction of the developer carrying member inside the first chamber is taken as Y (g), a developer carrying velocity in the longitudinal direction of the developer carrying member inside the first chamber is taken as $V_D$ (mm/sec), a toner carrying amount per unit area on the image bearing member at the time of formation of a maximum density image is taken as M (mg/cm$^2$), a surface movement velocity of the image bearing member is taken as $V_p$ (mm/sec), and the distance from a position furthest downstream in a direction in which developer is conveyed by the developer conveying member in a maximum area in which development is possible on the developer carrying member to the predetermined detection position in the longitudinal direction of the developer carrying member is taken as X (mm), the following relation is satisfied:

$$X \leqq (45 \times Y \times V_D)/(M \times V_p).$$

2. The image forming apparatus according to claim 1, further comprising:

developer replenishing means that replenishes developer for replenishment into the developing container, wherein the image density control means controls a toner density of developer in the developing container by controlling the developer replenishing means.

3. The image forming apparatus according to claim 1, wherein the image density control means controls formation conditions of the electrostatic image or developing conditions of the developing means.

4. The image forming apparatus according to claim 1, further comprising:

a plurality of the image bearing members and a plurality of the developing means;

transferring means which transfers respective toner images formed on the image bearing member onto the transferring medium by sequentially overlaying the toner images;

position detection image forming means that forms an image at the predetermined detection position for position detection for detecting misregistration of each of the toner images with respect to each other on the transferring medium; and image position control means that corrects misregistration based on a detection result of the density of the image at the predetermined detection position obtained by the image density detection means.

* * * * *